US010578411B2

(12) United States Patent
Jennett et al.

(10) Patent No.: US 10,578,411 B2
(45) Date of Patent: Mar. 3, 2020

(54) EXPLOSIVE DEVICE WITH CASING HAVING VOIDS THEREIN

(71) Applicant: Raytheon Company, Waltham, MA (US)

(72) Inventors: Gaston P. Jennett, Tucson, AZ (US); Dmitry V. Knyazev, Tucson, AZ (US); Robert P. Johnson, Tucson, AZ (US); Morgan J. Bakarich, Tucson, AZ (US); Michael A. Schurr, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 14/972,211

(22) Filed: Dec. 17, 2015

(65) Prior Publication Data

US 2016/0178336 A1 Jun. 23, 2016

Related U.S. Application Data

(60) Provisional application No. 62/093,695, filed on Dec. 18, 2014.

(51) Int. Cl.
*F42B 12/24* (2006.01)
*F42B 12/22* (2006.01)
(Continued)

(52) U.S. Cl.
CPC ..... *F42B 12/24* (2013.01); *F42B 12/207* (2013.01); *F42B 12/22* (2013.01); *F42B 12/32* (2013.01)

(58) Field of Classification Search
CPC ..... F42B 12/20; F42B 12/207; F42B 12/22; F42B 12/24; F42B 12/26; F42B 12/28; F42B 12/32
(Continued)

(56) References Cited

U.S. PATENT DOCUMENTS 2,798,431 A * 7/1957 Semon ..... F42B 12/22 102/495
3,580,175 A * 5/1971 Kenney ..... F42B 12/22 102/496
(Continued)

FOREIGN PATENT DOCUMENTS

DE 29 19 268 A1 11/1980
DE 2923877 A1 12/1980
(Continued)

OTHER PUBLICATIONS

Machine translation of FR 3 000 192 A1; (Year: 2012).*
(Continued)

*Primary Examiner* — James S Bergin
(74) *Attorney, Agent, or Firm* — Renner, Otto, Boissell & Sklar, LLP

(57) ABSTRACT

An explosive device, such as a munition or a part of a munition, has an explosive material surrounded by a casing that has one or more voids within the casing. The one or more voids define sizes and shapes of the fragments that the casing breaks into when the explosive material is detonated. The casing may be made using an additive manufacturing process, with the one or more voids fully between an inner surface of the casing and an outer surface of the casing. The voids may substantially define the size and shape of fragments making up a majority of the volume of the casing, such as 75% or more of the volume of the casing. The voids may change direction within the casing, for example branching and intersecting to define a plurality of rectangular (parallelepiped) or other shaped fragments.

14 Claims, 12 Drawing Sheets

(51) Int. Cl.
*F42B 12/32* (2006.01)
*F42B 12/20* (2006.01)

(58) Field of Classification Search
USPC ..... 102/491, 492, 493, 494, 495, 496, 497, 102/506
See application file for complete search history.

(56) References Cited

U.S. PATENT DOCUMENTS

| | | | | |
|---|---|---|---|---|
| 5,095,821 | A * | 3/1992 | Merz | F42B 12/26 102/389 |
| 5,126,105 | A * | 6/1992 | Runkle | B22F 3/04 419/30 |
| 5,198,616 | A * | 3/1993 | Anderson | F42B 12/74 102/501 |
| 5,852,256 | A * | 12/1998 | Hornig | F42B 12/76 102/473 |
| 6,484,642 | B1 * | 11/2002 | Kuhns | F42B 12/24 102/493 |
| 7,093,542 | B2 | 8/2006 | Gousman et al. | |
| 9,568,291 | B2 * | 2/2017 | Simon | F42B 12/24 |
| 9,738,947 | B1 * | 8/2017 | Deshpande | C21D 9/16 |
| 10,018,453 | B1 * | 7/2018 | McCoy | F42B 12/24 |
| 2009/0205529 | A1 | 8/2009 | Lloyd | |

FOREIGN PATENT DOCUMENTS

| | | | | |
|---|---|---|---|---|
| DE | 4025097 | A1 | 2/1992 | |
| FR | 2 480 427 | A1 | 10/1981 | |
| FR | 2590823 | A1 | 6/1987 | |
| FR | 2 685 077 | A1 | 6/1993 | |
| FR | 2 867 849 | A1 | 9/2005 | |
| FR | 3 000 192 | A1 | 12/2012 | |
| FR | 3000191 | A1 * | 6/2014 | F42B 12/22 |
| FR | 3000192 | A1 * | 6/2014 | F42B 12/22 |

OTHER PUBLICATIONS

International Search Report and Written Opinion from corresponding International Application No. PCT/US2015/066248 dated Mar. 11, 2016.

Communication pursuant to Article 94(3) EPC received in corresponding European Patent Application No. 15820970.0 dated Aug. 29, 2018.

Response filed Dec. 18, 2018, in corresponding European Patent Application No. 15820970.0.

Communication pursuant to Article 94(3) EPC received in corresponding European Patent Application No. 15820970.0 dated May 22, 2019.

* cited by examiner

EXPLOSIVE DEVICE WITH CASING HAVING VOIDS THEREIN

This application claims priority under 35 USC 119 to U.S. Provisional Application 62/093,695, filed Dec. 18, 2014, which is incorporated by reference in its entirety.

FIELD OF THE INVENTION

The invention is in the field of explosive devices, and more particularly to devices such as munitions that expel fragments.

DESCRIPTION OF THE RELATED ART

FIG. 1 shows a prior art explosive device 10 that includes an explosive 12 inside a casing 14. When the explosive 12 detonates, the casing 14 breaks as shown in FIG. 2, with the casing 14 forming a series of uneven fragments 16 that are propelled outward from the device 10, using the force of the explosive 12 in a detonation 18. The unevenness of the fragments 16 interferes with the effectiveness of the device 10, in that the fragments have unpredictable sizes and shapes, unpredictable spacing, and unpredictable directions and extent of travel away from the explosive device 10.

FIG. 3 shows another prior art explosive device, a device 20 in which an explosive 22 is surrounded by a casing 24 that is scored or notched on its inner surface 25. The scoring causes some preferential breakup of the casing 24 along the score lines when the explosive 22 is detonated in a detonation 28, as illustrated in FIG. 4. However, there is still unevenness in fragments 26 that are produced by the breakup from the casing. For example, some of the fragments 26 may be larger than others in an unpredictable way, since the casing 24 may not break along all of the notches along the inner surface 25. Again the result may be unpredictability in the performance of the device 20.

FIG. 5 shows a prior art explosive device 30 which has an explosive 32 surrounded by a thin case 34. On the outside of the case 34 a series of preformed fragments 36 are attached using an adhesive 38. When the explosive 32 is detonated, as illustrated in FIG. 6, the thin case 34 breaks up into small particles and the adhesive may be essentially consumed or transformed into tiny particles. The preformed fragments 36 are expelled or propelled outward in a detonation 40. The device 30 does do a good job in distributing fragments of a desired size, in a desired configuration, but the device 30 is expensive and time-consuming to make. A large number of the fragments 36 must be placed where desired on the thin case 34, and quality control is important both in the placement of the fragments 36 and in maintaining desired quality for the adhesive 38 that is used to hold the fragments 36 in place.

From the foregoing it will be appreciated that problems exist with current configurations of explosive devices used to produce fragments.

SUMMARY OF THE INVENTION

According to an aspect of the invention, an explosive device includes: a casing; and an explosive material within the casing; wherein the casing has one or more voids therein.

According to an embodiment as in any preceding paragraph(s), the one or more voids define fragments of the casing that are propelled from the device when the explosive material is detonated.

According to an embodiment as in any preceding paragraph(s), the fragments include rectangular, cubic, regular polyhedral, irregular polyhedral, parallelepiped fragments, or spheres.

According to an embodiment as in any preceding paragraph(s), the fragments are all of the same size.

According to an embodiment as in any preceding paragraph(s), the fragments include fragments of different sizes.

According to an embodiment as in any preceding paragraph(s), some of the fragments are at least twice the volume, or at least four times the volume, of other of the fragments.

According to an embodiment as in any preceding paragraph(s), the explosive device is part of a munition.

According to an embodiment as in any preceding paragraph(s), the explosive device is part of a warhead, such as for a missile.

According to an embodiment as in any preceding paragraph(s), the voids include branching and/or intersecting passages.

According to an embodiment as in any preceding paragraph(s), the casing is made of metal, such as being made of stainless steel alloys, nickel alloys, nobalt-chrome alloys, nickel-chromium based alloys (such as those sold under the trademark INCONEL), titanium alloys, or aluminum alloys.

According to an embodiment as in any preceding paragraph(s), the casing is made of plastic.

According to an embodiment as in any preceding paragraph(s), the casing includes webs on opposite ends of the voids, with the webs being broken by shock stress and pressure forces due to detonation of the explosive material.

According to an embodiment as in any preceding paragraph(s), a major direction of at least some of the voids is perpendicular to major surfaces of casing.

According to an embodiment as in any preceding paragraph(s), a major direction of at least some of the voids is not perpendicular to major surfaces of casing.

According to an embodiment as in any preceding paragraph(s), major directions of the voids are in multiple directions relative to major surfaces of casing.

According to an embodiment as in any preceding paragraph(s), the casing is made by an additive manufacturing process.

According to an embodiment as in any preceding paragraph(s), the casing is made by laser sintering.

According to an embodiment as in any preceding paragraph(s), a material is in the voids.

According to an embodiment as in any preceding paragraph(s), the material in the voids is a powdered casing material.

According to an embodiment as in any preceding paragraph(s), the material in the voids is a liquid.

According to an embodiment as in any preceding paragraph(s), wherein the material in the voids is a phase-change material.

According to an embodiment as in any preceding paragraph(s), wherein the phase-change material is a solid.

According to an embodiment as in any preceding paragraph(s), wherein the phase-change material is a liquid.

A method of using an explosive device, the method including: detonating an explosive that is within the casing; and using force from detonation of the explosive to break the casing into fragments; wherein the casing breaks into fragments along voids within the casing.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The appended figures, which may not necessarily be to scale, show various aspects of the prior art and embodiments of the present invention.

DETAILED DESCRIPTION

An explosive device, such as a munition or a part of a munition, has an explosive material surrounded by a casing that has one or more voids within the casing. The one or more voids define sizes and shapes of the fragments that the casing breaks into when the explosive material is detonated. The casing may be made using an additive manufacturing process, with the one or more voids fully between an inner surface of the casing and an outer surface of the casing. The voids may substantially define the size and shape of fragments making up a majority of the volume of the casing, such as 75% or more of the volume of the casing. The voids may change direction within the casing, for example branching and intersecting to define a plurality of rectangular (parallelepiped) or other shaped fragments, with thin webs at the tops and bottoms of the voids broken by the force of the explosion of the explosive material enclosed by the casing. The resulting fragments may be propelled from the explosive device in a predictable pattern, while having the casing be a single piece and still easy to manufacture.

Figure 2:
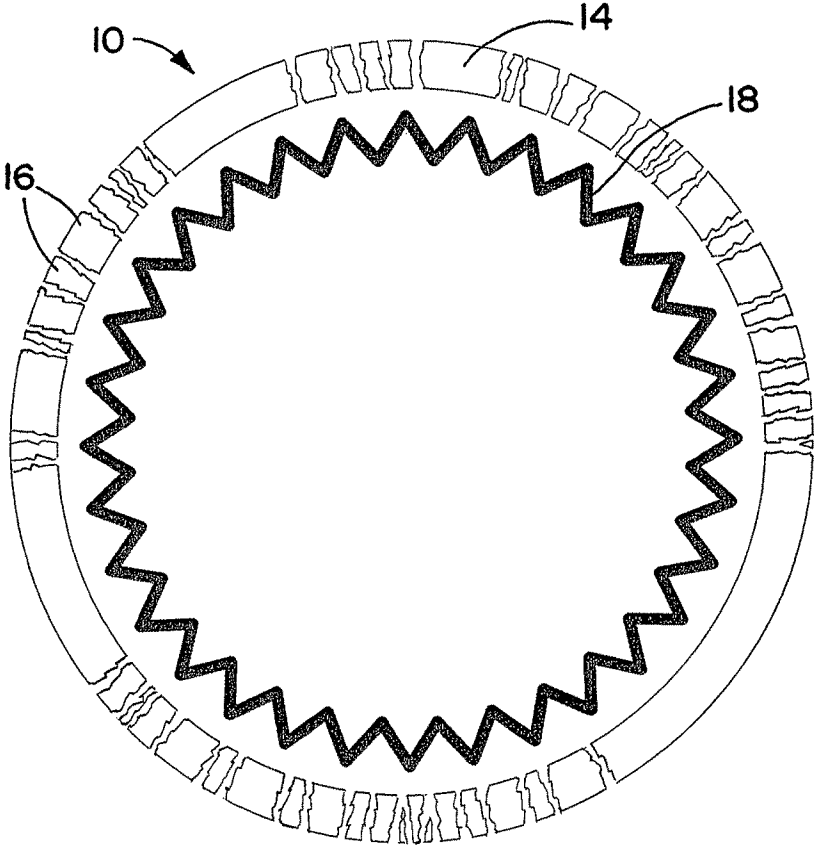
FIG. 2 Prior Art
FIG. 2 is a cross-sectional view illustrating detonation of the prior art explosive device of FIG. 1.
Figure 1:
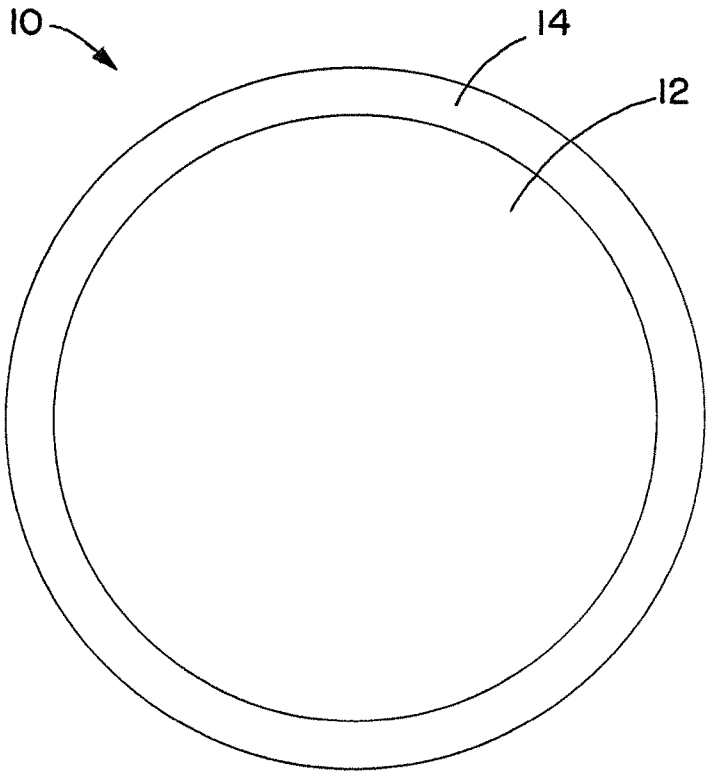
FIG. 1 Prior Art
FIG. 1 is a cross-sectional view of a prior art explosive device.
Figure 4:
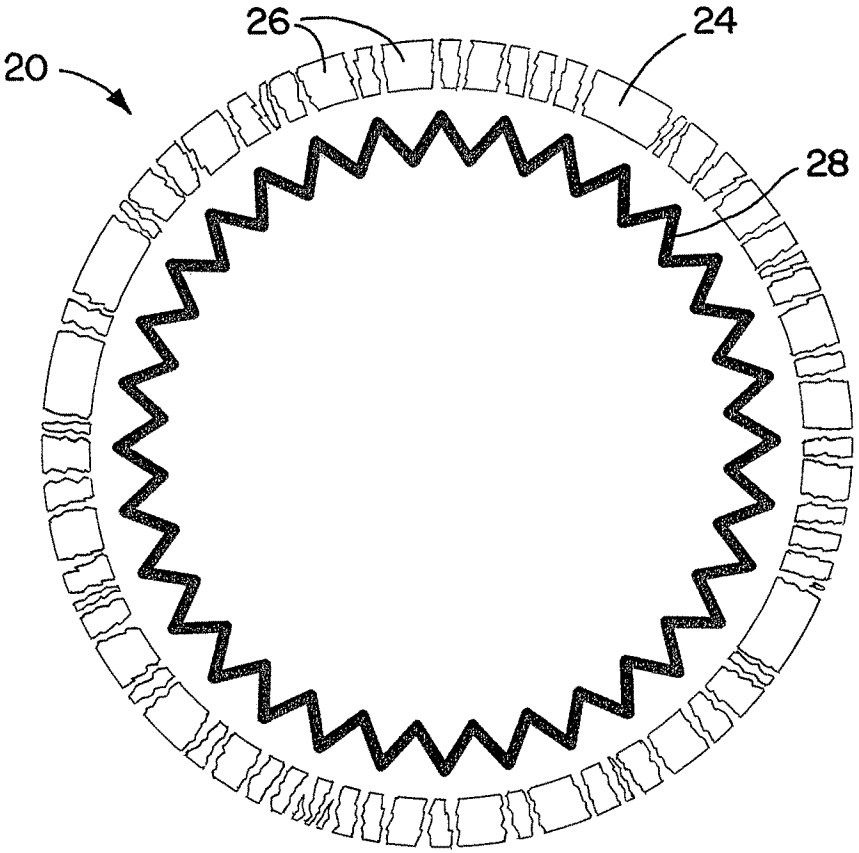
FIG. 4 Prior Art
FIG. 4 is a cross-sectional view illustrating detonation of the prior art explosive device of FIG. 3.
Figure 3:
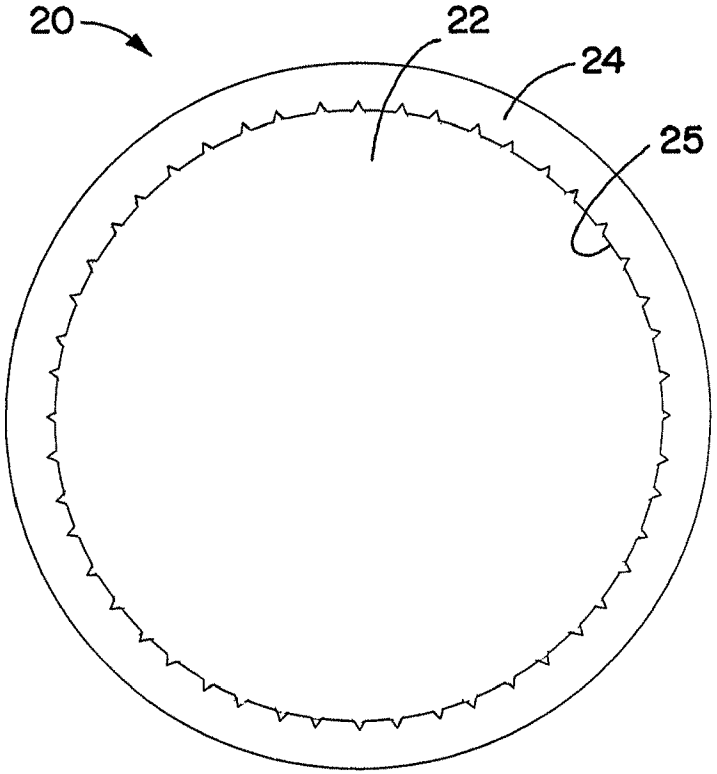
FIG. 3 Prior Art
FIG. 3 is a cross-sectional view of another prior art explosive device.
Figure 6:
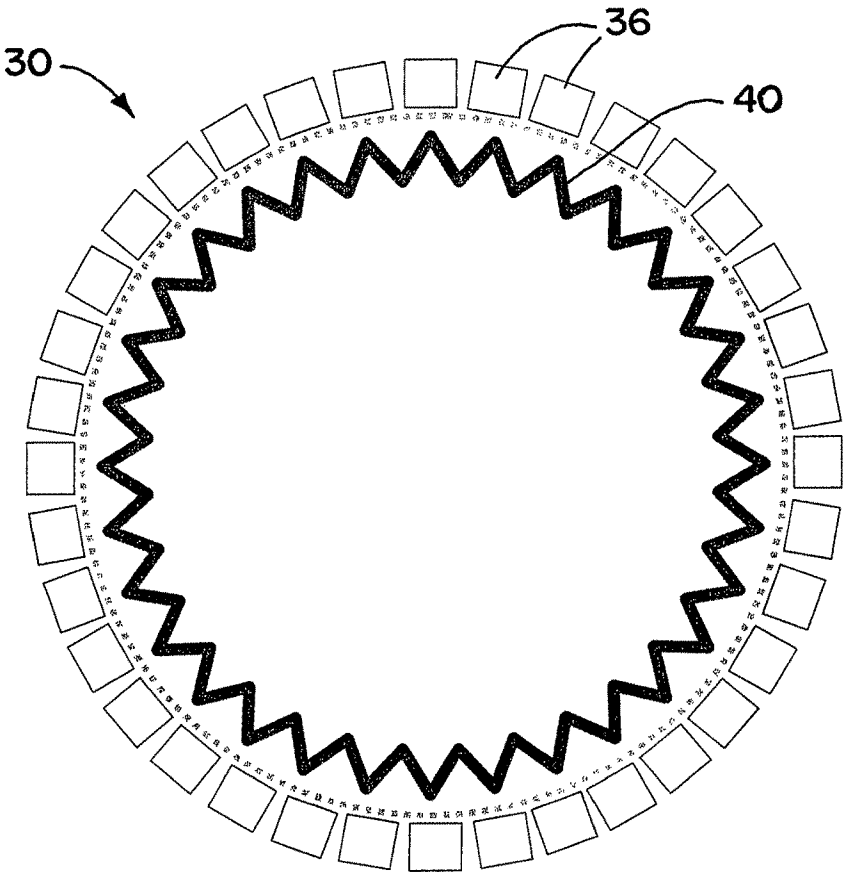
FIG. 6 Prior Art
FIG. 6 is a cross-sectional view illustrating detonation of the prior art explosive device of FIG. 5.
Figure 5:
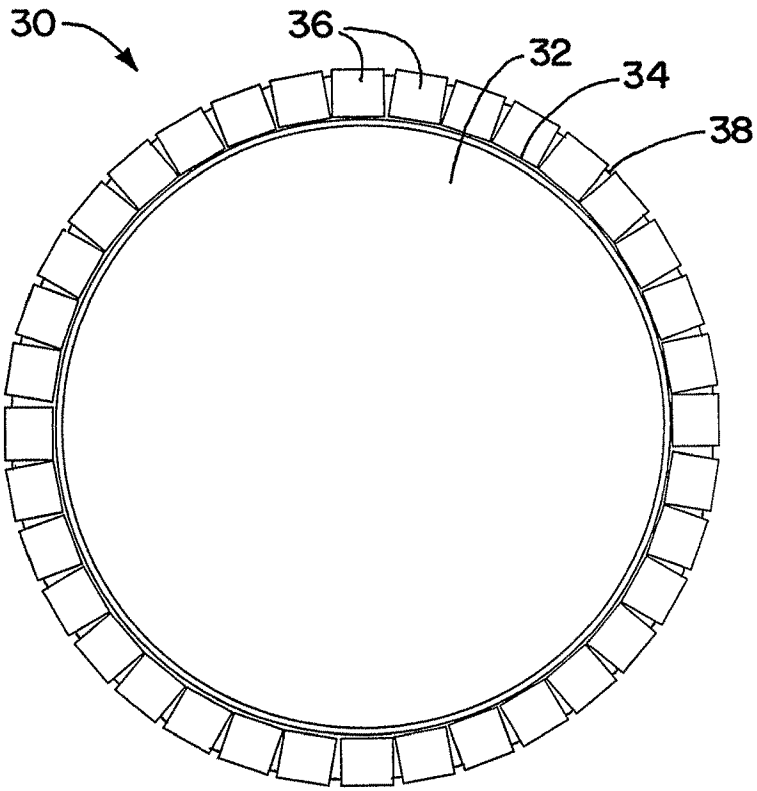
FIG. 5 Prior Art
FIG. 5 is a cross-sectional view of yet another prior art explosive device.
Figure 8:
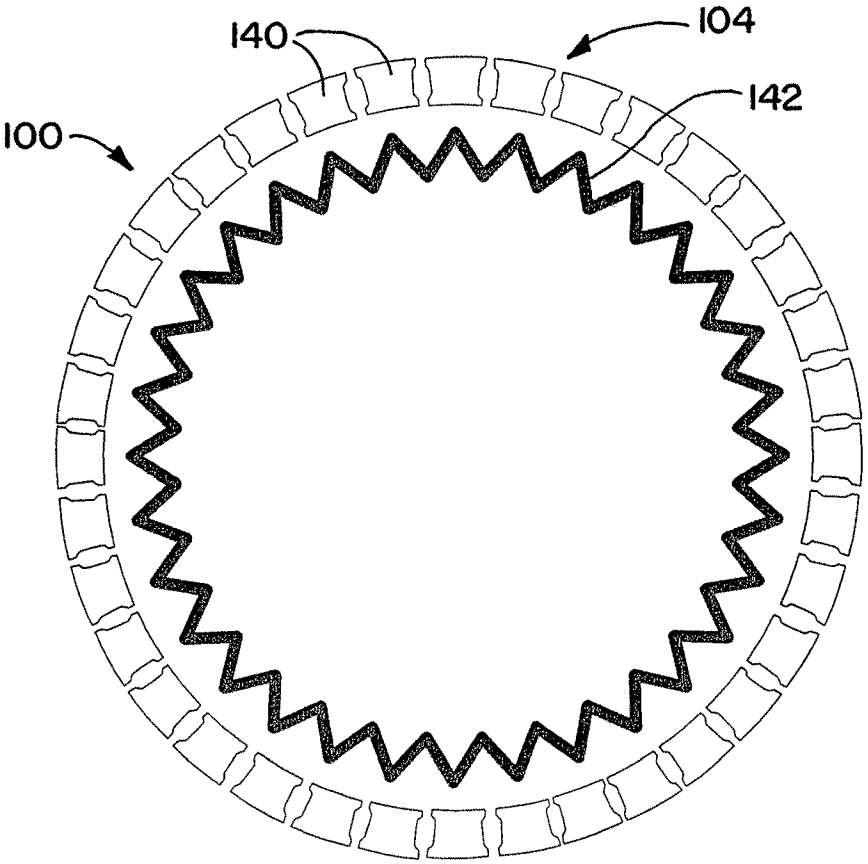
FIG. 8 is a cross-sectional view illustrating detonation of the explosive device of FIG. 7.
Figure 7:
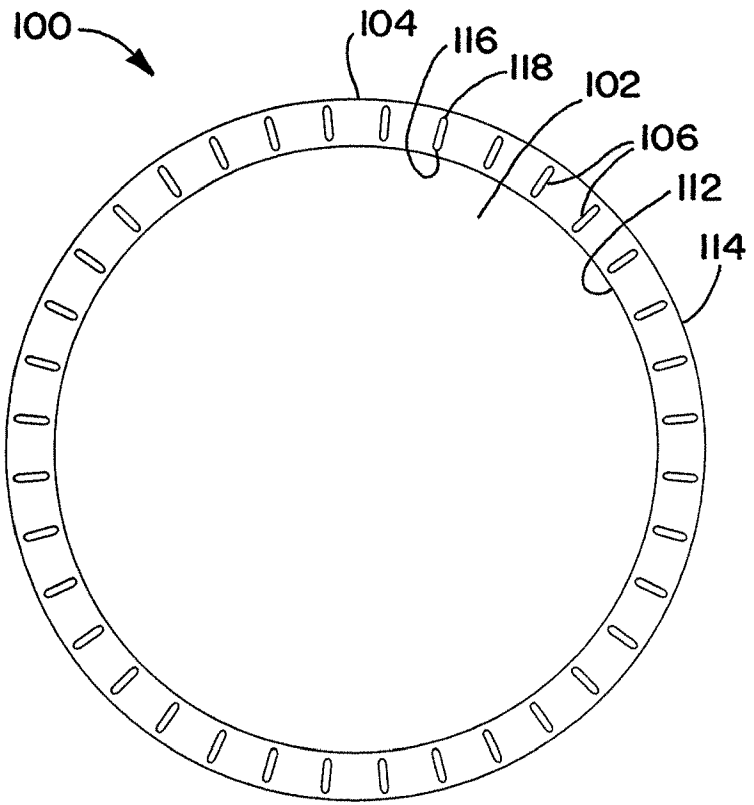
FIG. 7 is a cross-sectional view of an explosive device, according to an embodiment of the present invention.

Referring now to FIGS. 7 and 8, an explosive device 100 has an explosive material 102 that is surrounded by a casing 104. The casing 104 has one or more voids 106 internal to the casing 104. The voids 106 may be fully between an inner surface 112 of the casing 104, which faces the explosive material 102, and an outer surface 114 of the casing 104. The voids 106 may extend from close to the inner surface 112 to close to the outer surface 114. This leaves thin webs of casing material on opposite sides of the voids 106, a thin inner web 116 at the inner surface, and a thin outer web 118 at the outer surface 114. The webs 116 and 118 may each have a thickness of that is less than ⅓ of the total thickness of the casing 104, which allows the webs 116 and 118 to be easily broken by the outward force on the casing 104 from the detonation of the explosive material 102. For example the web thicknesses may be from 0.76 mm (0.03 inches) to 8.4 mm (0.33 inches), although other thicknesses are possible. The case thickness is the combination of the fragment thickness and the outer and inner web thicknesses and can vary widely depending on the application and desired effect The explosive material 102 may be any of a variety of suitable explosives that are used in munitions. Examples of suitable explosives include curable or pre-set polymer bonded explosives (PBX). Other suitable explosives may also be used as alternatives.

The voids 106 define fragments 140 that the casing 104 breaks into when the explosive material 102 is detonated at a detonation 142, as illustrated in FIG. 8. The fragments 140 may be well defined, with the voids 106 for example running along the entire perimeter (or close to the entire perimeter) of each of the fragments 140.

Figure 9:
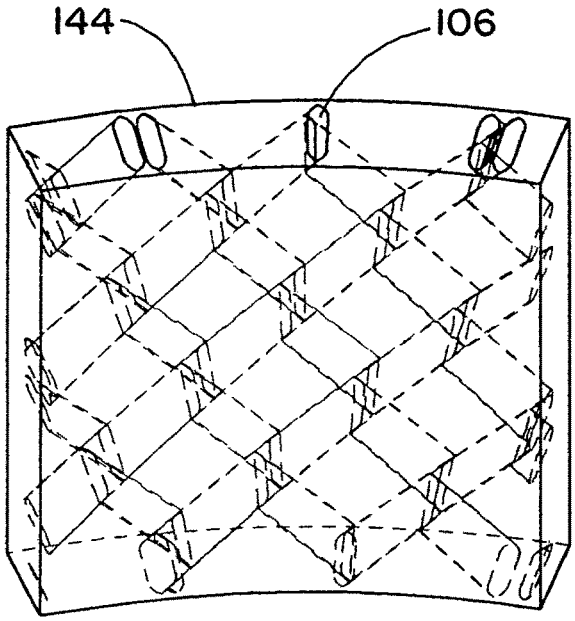
FIG. 9 is an illustration of the configuration of a portion of the casing of an alternate embodiment explosive device.
Figure 10:
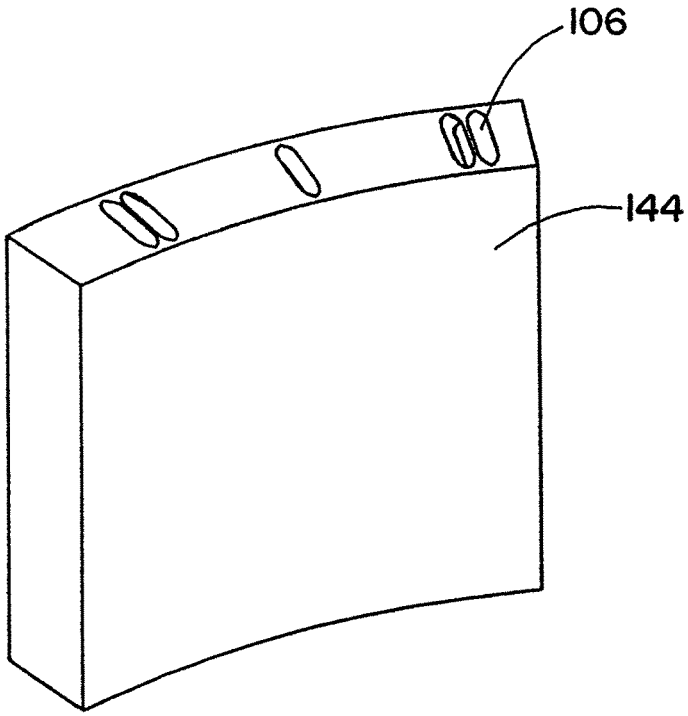
FIGS. 10, 11, 12, 13, 14, and 15 illustrate successively smaller parts of the casing portion of FIG. 9.
Figure 11:
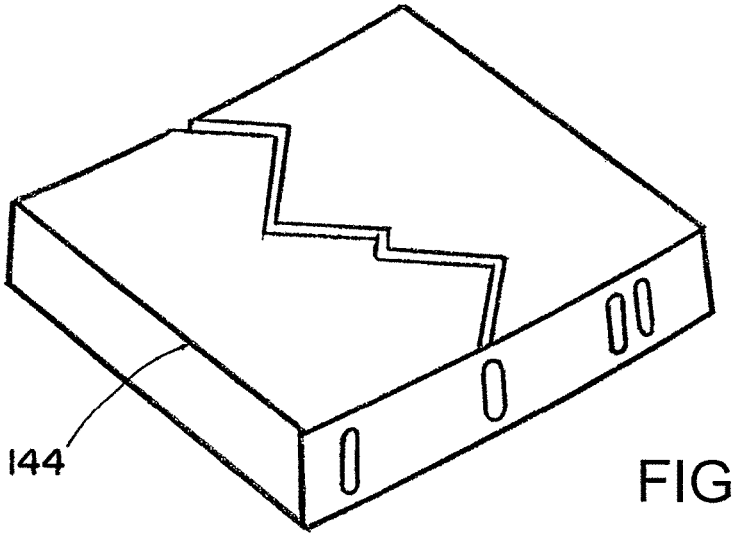
Figure 12:
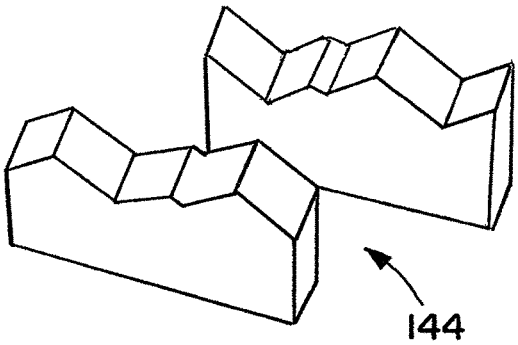
Figure 13:
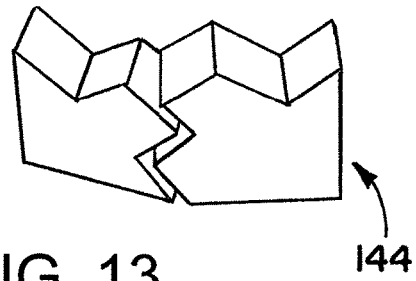
Figure 14:
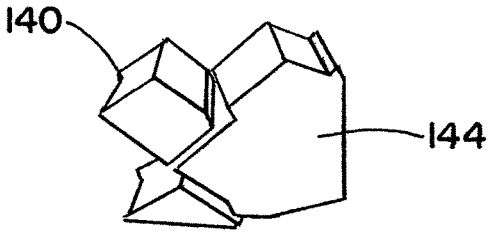
Figure 15:
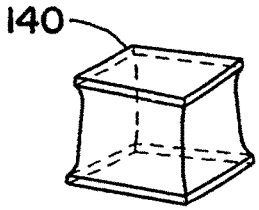

FIG. 9 illustrates one possible configuration for the voids 106 within a portion 144 of the casing 104. The voids 106 (which may together constitute a single void that has all of its various passages in fluid communication with one another) may define a series of rectangular cross section fragments 140. The fragments 140 all may have substantially square cross section shapes, although the casing 104 may be generally cylindrical, making the fragments 140 portions of a cylindrical shell. The fragments 140 all may have substantially the same size and shape.

FIGS. 10-15 illustrate the breakdown of the casing portion 144 into individual fragments, such as the fragment 140. Although the breakdown of the casing portion 144 is shown as a series of steps for purposes of illustration, in actual use all of the fragments 140 are separated from one another and from the remainder of the casing 104 substantially simultaneously, upon the detonation of the explosive material 102 (FIG. 7).

An initiator or booster (not shown) may be used to detonate the explosive material 102 (FIG. 7) of the explosive device 100 (FIG. 7). The initiator or booster may be operatively coupled to the explosive material 102 in any of a variety of suitable ways. For example the initiator or booster may be placed in the explosive material 102, such as in a central location within the explosive material 102, completely surrounded by the explosive material 102. The initiator or booster (or detonator) may be configured to detonate the explosive material 102 in any of a variety of suitable ways, for example at a height of burst, upon impact, or at a certain proximity to a target (to give a few non-limiting examples).

The casing 104 (and the explosive device 100) shown in FIGS. 7-15 is only one possible configuration of an explosive device having voids within a casing. The illustrated explosive device 100 is a part of a warhead for a munition, and has a cylindrical shape. However the explosive device 100 may have other shapes, and/or may be used for other purposes or may be a part of devices that perform other purposes. For example the explosive device 100 may alternatively have a spherical shape or other suitable shape. The explosive device 100 alternatively may be a part of other munitions, such as bombs. The explosive device 100 also may be part of non-munition devices, for example perforators used in the oil industry, or even fireworks, where spread of combustible material is desired for achieving a visual effect.

The casing 104 may be made of a suitable metal, for example stainless steel alloys, nickel alloys, cobalt-chrome alloys, nickel-chromium based alloys (such as those sold under the trademark INCONEL), titanium alloys, or aluminum alloys. Alternatively, the casing 104 may be made of a suitable non-metal, for example any of a variety of suitable plastics or other suitable non-metal materials.

The casing 104 may be manufactured using an additive manufacturing technique, where the casing 104 is built up layer by layer, with the voids 106 produced by omitting solid material from the layers as appropriate. "Additive manufacturing" is broadly used herein to refer to processes in which features are formed by selectively adding material, as opposed to removing material from an already-existing larger structure (subtractive manufacturing). Such a process is often referred to generally as three-dimensional printing. In a specific embodiment, the casing 104 may be built up from layers of 10-micron stainless steel particles (spheres) that are selectively fused using laser sintering. Other additive manufacturing processes may be used alternatively, or in addition, in making the casing 104. The size and form of the additive materials are dependant upon the manufacturing equipment and specific process.

Subtractive manufacturing processes, such as machining, may be used in making some of the features on the casing 104. For example, the main casing 104 may be made by an additive manufacturing process, with the voids 106 formed during the additive manufacturing process, as described above. After the additive manufacturing, other features of the casing 104 may be produced by subtractive manufacturing processes such as machining. For example, a ridge to allow mounting of the casing 104 onto a fuselage or other structure may be machined after the casing 104 is initially formed. As another example, holes, such as threaded holes, may be drilled or otherwise formed into an edge of the casing 104, to facilitate mounting of the explosive device 100 on another structure.

The voids 106 may be left empty (filled with air), or alternatively may be filled in whole or in part with another material. The voids 106 may be filled with the same material as the solid parts of the casing 104, but in unsolidified form (not attached to and made a part of the main structural portions of the casing 104). For example the voids 106 may be filed with metal particles, such as stainless steel particles. Such particles may provide greater structural integrity to the casing 104 prior to detonation of the explosive material 102, while still allowing the casing 104 to split up into the various fragments 140 when the explosive material 102 is detonated.

The voids 106 may alternatively be filled with another type of solid material, or may be filled in whole or in part with a liquid. A liquid may provide structural support to the casing 104 when the explosive device 100 undergoes certain stresses, such as during launch of a missile that the explosive device 100 is part of. The liquid may be a liquid that does not significantly resist shearing, and therefore does not interfere with the separation of the casing 104 into the fragments 140.

The material in the voids 106 may be a phase-change material, either a solid material that melts when heated, or a liquid that boils or evaporates when heated. Such a phase-change material may aid in enhancing the safety of the explosive device 100 by improving the cook-off characteristics of the explosive device 100, better allowing the device 100 to withstand a fire or other heating device without detonating. The voids 106 may be vented to allow vaporized phase-change material to exit, to avoid a build-up of pressure within the voids 106. An example of a solid phase-change material is wax.

Figure 16:
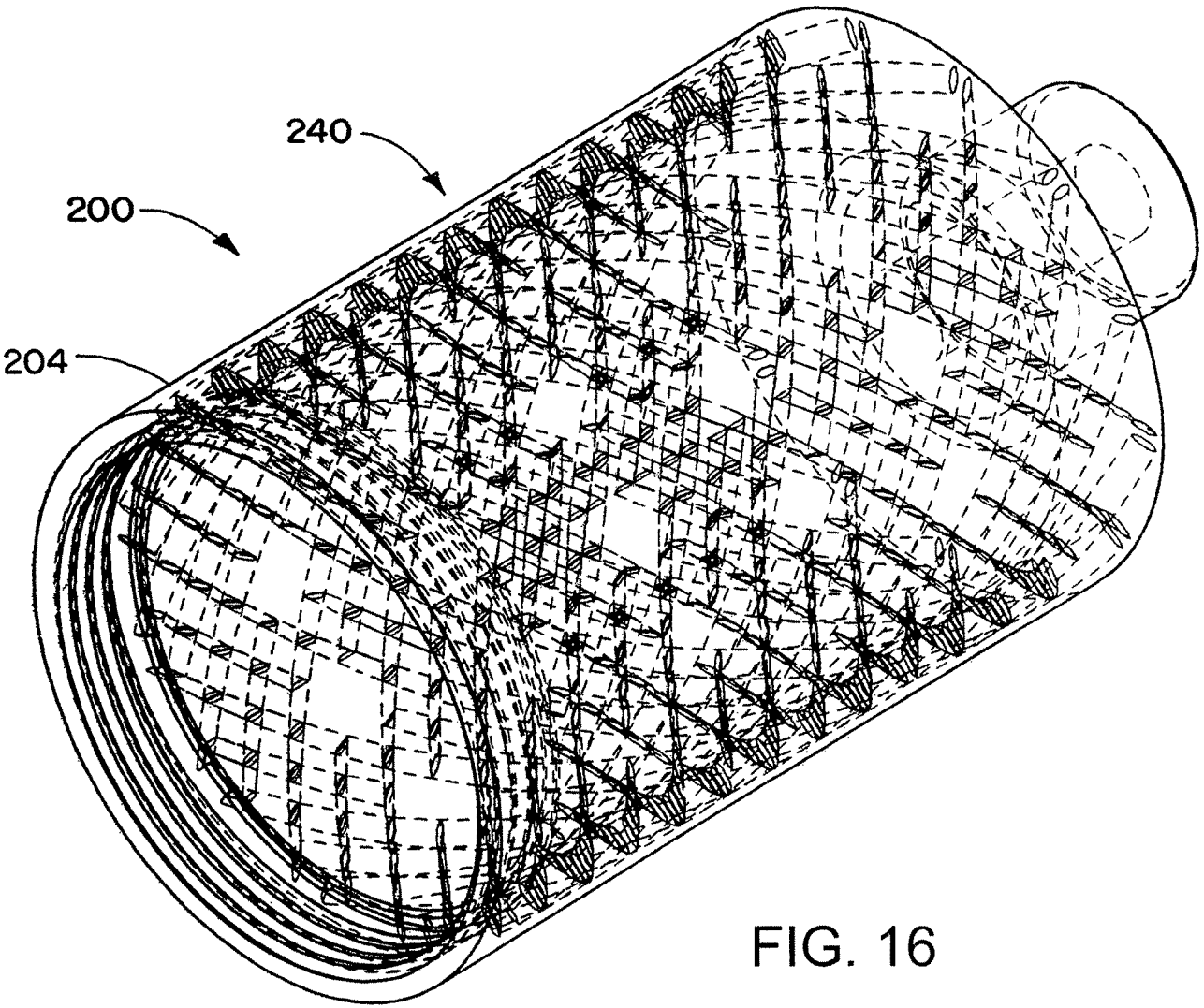
FIG. 16 is an oblique view showing another alternate embodiment explosive device.
Figure 17:
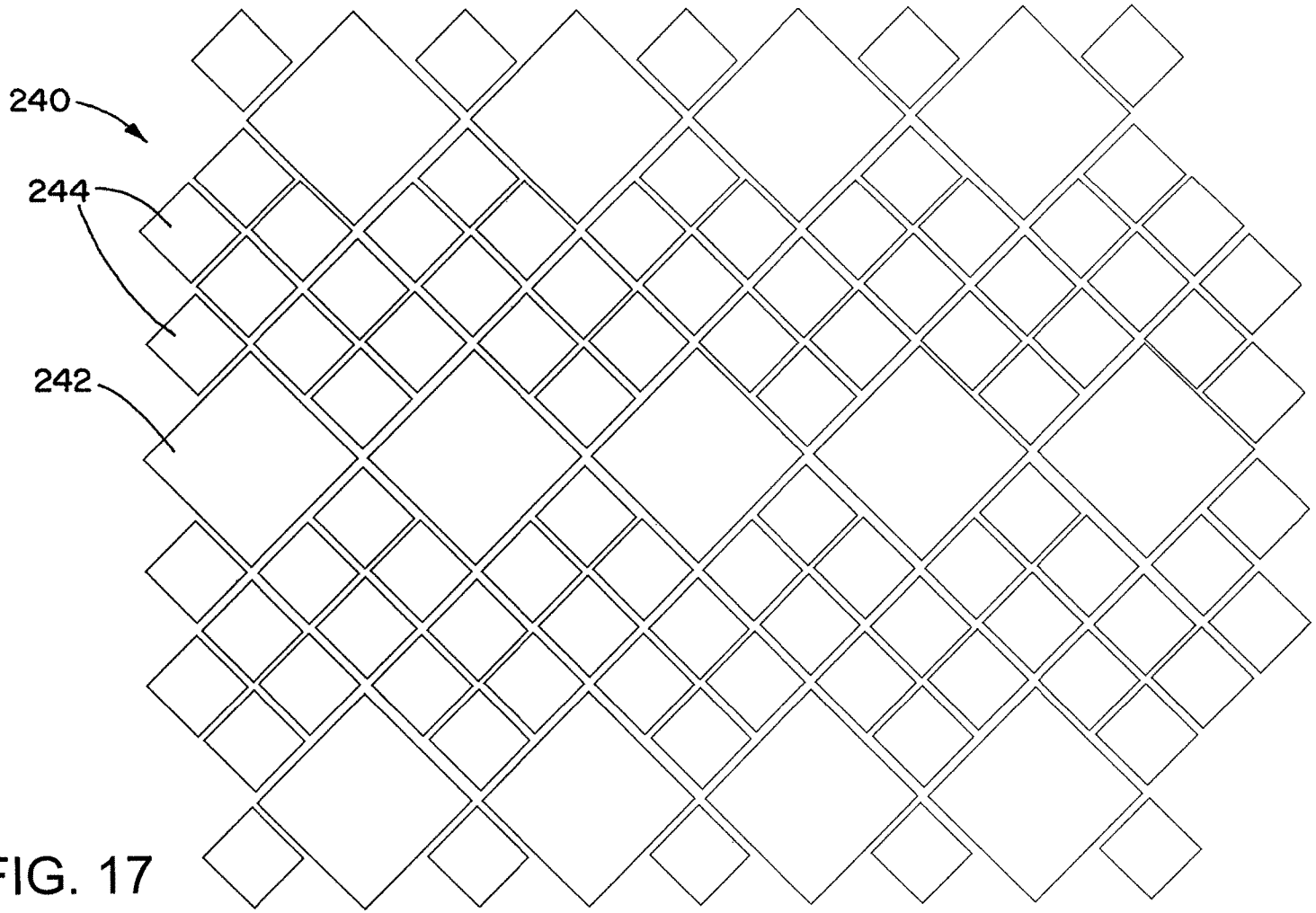
FIG. 17 is an illustration of the fragment pattern of part of the device casing of FIG. 16.

FIGS. 16 and 17 illustrate an alternate embodiment casing 204 having one or more voids 206 that define fragments 240 having multiple sizes. The fragments 240 include relatively large fragments 242 and relatively small fragments 244. As stated above, there may be a variety of different sizes and/or shapes of fragments at different locations, to produce different effects, such as for use in targeting a mixed target set.

Figure 18:
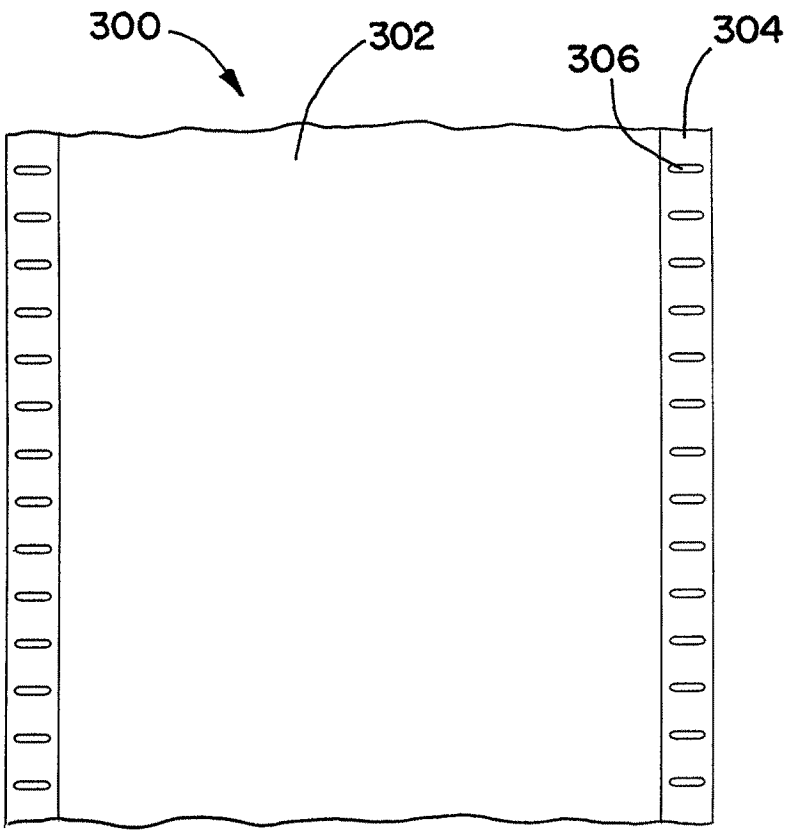
FIG. 18 is a cross-sectional view of part of an explosive device according to yet another alternate embodiment.

The voids in a casing may oriented perpendicular to the inner and outer surfaces of a casing. This is illustrated in FIG. 18 wherein voids 306 in a cylindrical casing 304 of an explosive device 300 are perpendicular to an inner surface 330 and an outer surface 334 of the casing 304. An explosive material 302 is enclosed by the cylindrical casing 304.

Figure 19:
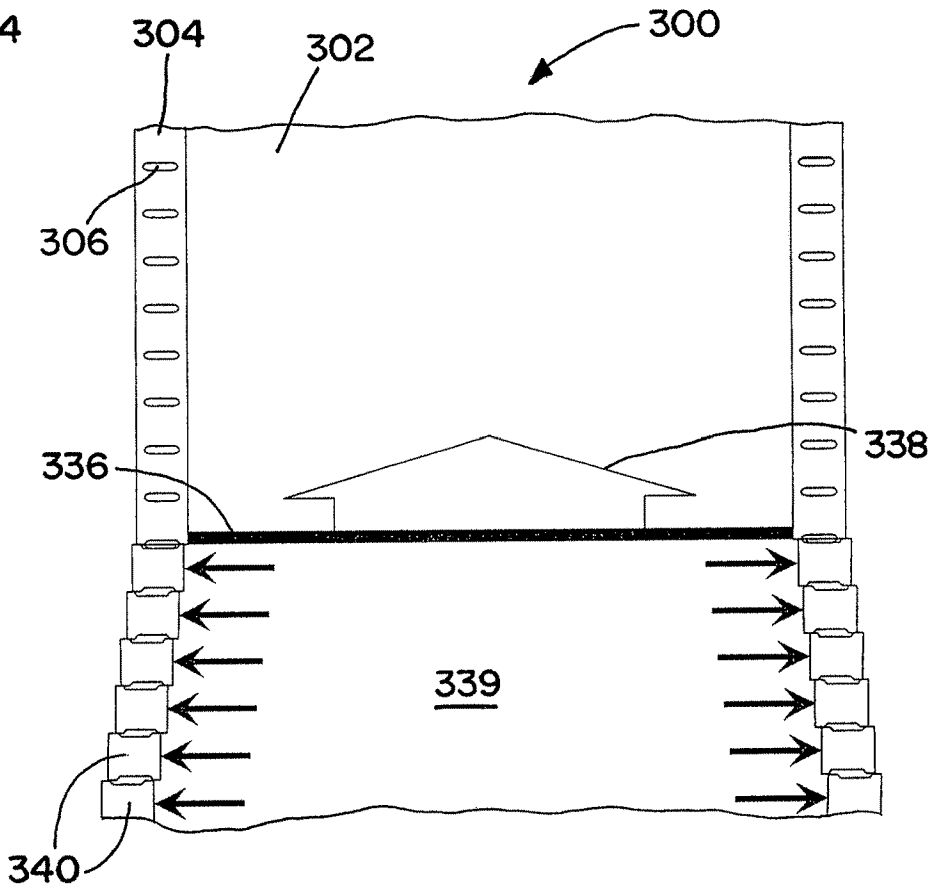
FIG. 19 is a cross-sectional view schematically illustrating the breakup of the casing of the device of FIG. 18, following detonation of the explosive of the device.

With reference to FIG. 19, when the explosive material 302 is detonated, a detonation front 336 travels along the explosive device 300, in the upward direction 338 as shown in the figure. Shock and gas pressure behind the detonation front 336, in a region 339. This pressure breaks the casing 304 along the voids 306, with the casing 304 being broken into fragments 340.

Figure 20:
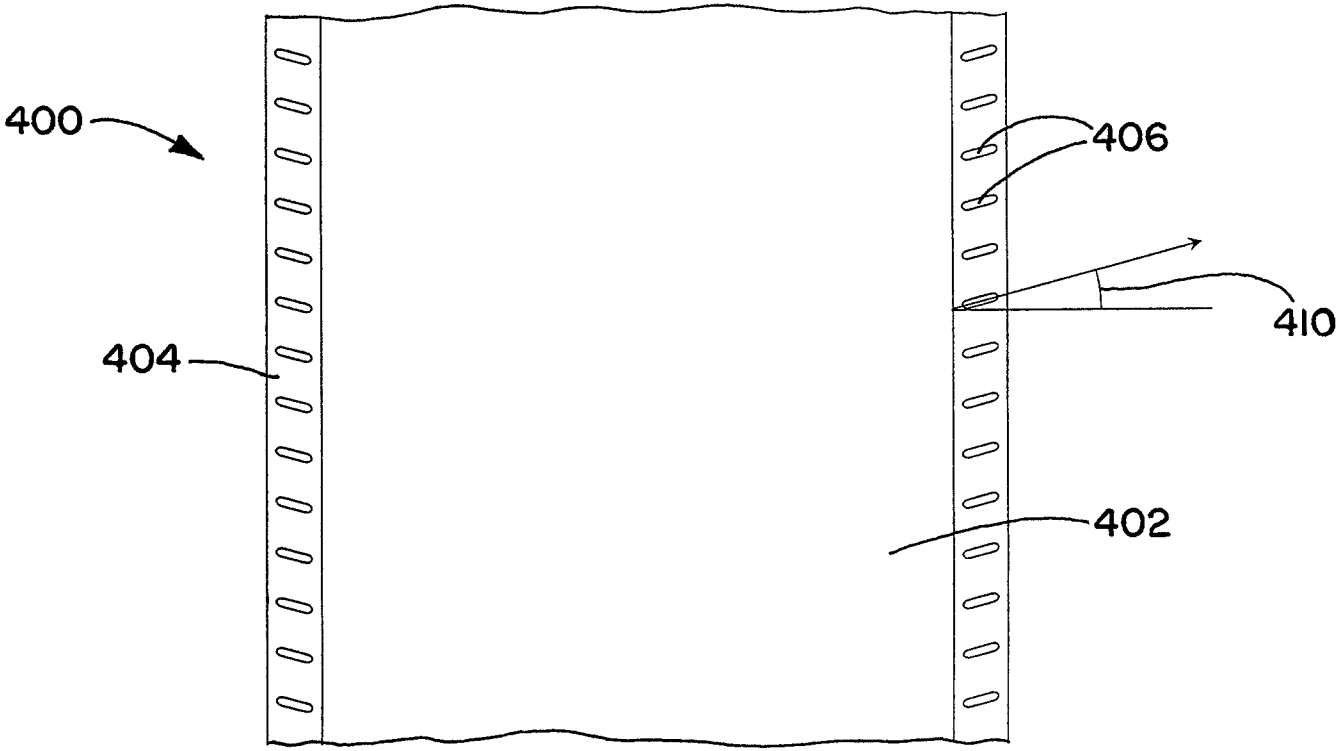
FIG. 20 is a cross-sectional view of part of an explosive device according to still another alternate embodiment.

Alternatively the voids may be other than normal to the inner and outer surfaces. This is illustrated in FIG. 20, where an explosive device 400 has a casing 404 with voids 406 at an angle corresponding to a Taylor angle 410 which results from the interaction between the detonation wave traveling through an explosive material 402 and the acceleration forces imparted on the fragments 440. In the illustrated embodiment the Taylor angle 410 is selected for a detonation front traveling vertically upward in the illustration. The orientation of the voids 406 can be selected to take advantage of detonation physics, for example to influence trajectory of the fragments and to protect fragment integrity.

Figure 21:
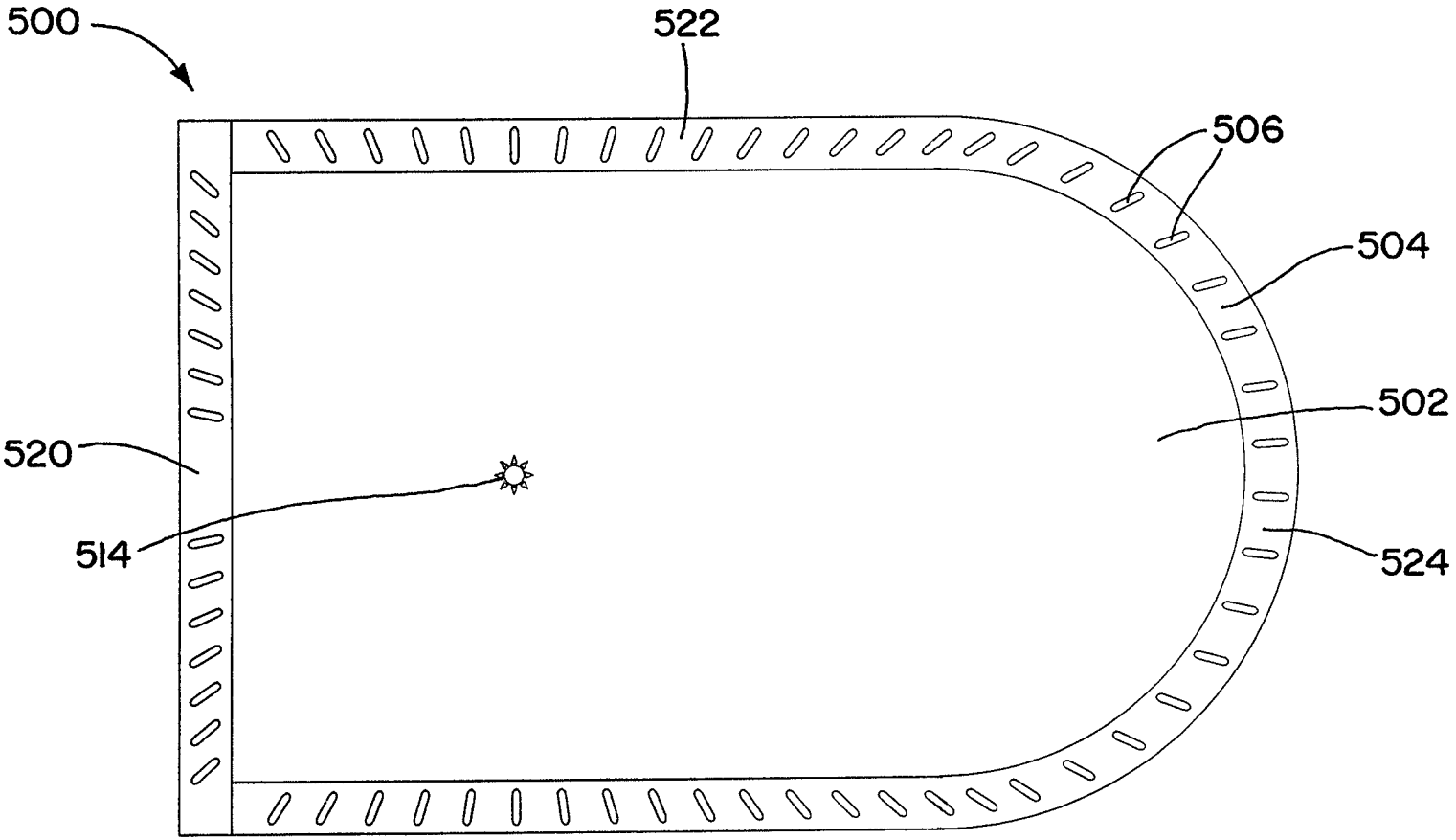
FIG. 21 is a cross-sectional view of part of an explosive device according to a further alternate embodiment.

FIG. 21 shows a device 500 that has a casing 504 with voids 506 oriented at various angles to take into account the movement of the detonation front through an explosive material 502, beginning at an initiation point 514, which is where a detonator or initiator may be located. The voids 506 change orientation throughout a flat portion 520, a cylindrical portion 522, and a spherical portion 524 of the casing 504. The orientation of the voids 506 may be selected to achieve a desired spread of fragments emanating from the device 500.

Figure 22:
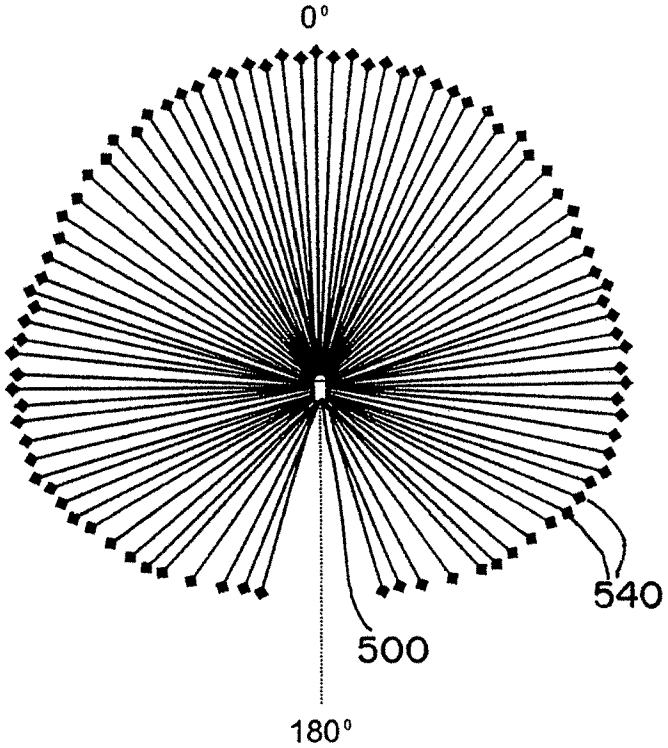
FIG. 22 is a plan view showing the spread of fragments from the explosive device of FIG. 21.

Many possible spreads of fragments are possible. FIG. 22 shows a fragment pattern that may be produced by detonating the device 500, with fragments 540 being sprayed out in a various directions all around the device 500.

Figure 23:
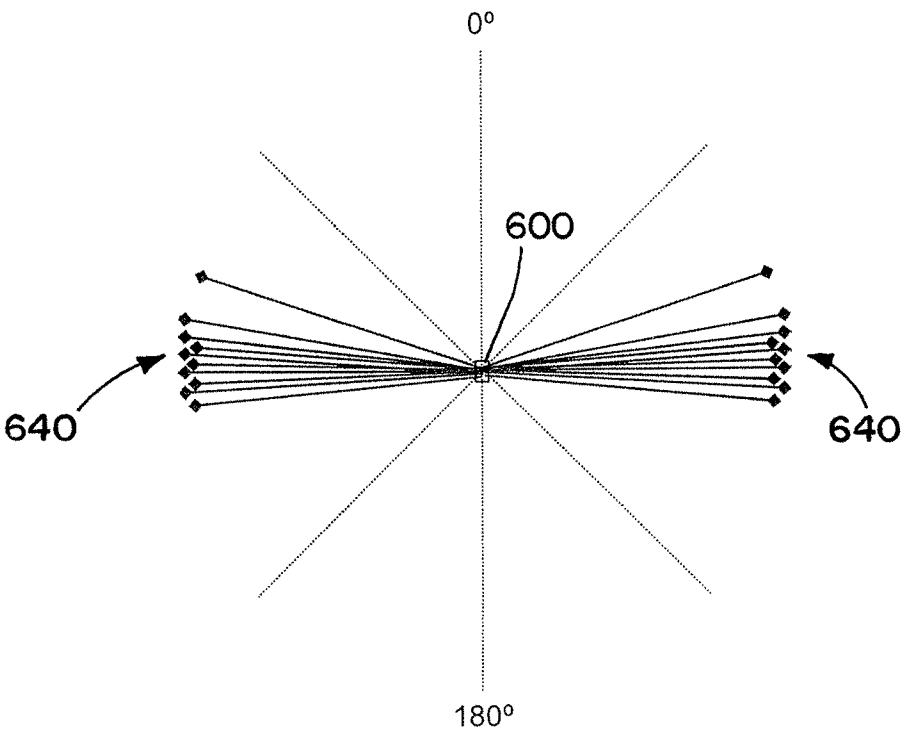
FIG. 23 is a plan view showing the spread of fragments from a still further alternate embodiment explosive device.

The voids may be located within a casing to expel fragments asymmetrically around the explosive device. This is illustrated in FIG. 23, where a pattern of fragments 640 emanating from detonation of an explosive device 600 is shown. The fragments 640 are in a generally cylindrical pattern of limited angle, with substantially no fragments expelled toward the front of the explosive device 600 (angle 0° in the figure) or toward the rear of the explosive device 600 (180° in the figure). This configuration of fragments might be expected from a cylindrical warhead or other device, with voids to produce fragments only along a cylindrical casing or portion of a casing. Many configurations of the fragments are possible, to achieve a variety of different effects, such as providing provision in the damage caused by a missile or other munition that includes an explosive device.

Figure 24:
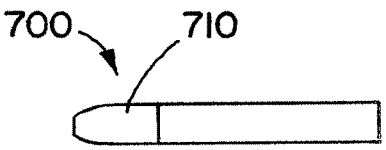
FIG. 24 is a side view of a missile that includes an explosive device of the present invention as a warhead.

FIG. 24 shows a missile 700 with an explosive device 710 at its nose. The explosive device 710 is representative of any of the explosive device embodiments described herein. The missile 700 is an example of one type of munition of which an explosive device may be a part. The explosive device 710 may be a warhead (as illustrated), or alternatively may be another part of a missile or other munition (such as a bomb or projectile).

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An explosive device comprising:

a casing; and an explosive material within the casing;

wherein the casing has one or more voids therein, with the casing being a single-piece casing and the one or more voids being internal to the casing, fully between an inner surface of the casing that faces the explosive material, and an outer surface of the casing;

wherein the one or more voids include branching and/or intersecting passages;

wherein the one or more voids define fragments of the casing that are propelled from the device when the explosive material is detonated;

wherein the one or more voids contain a powdered solid that fills in the one or more voids and that provides greater structural integrity to the casing; and wherein the powdered solid in the one or more voids, and the casing, have the same composition.

2. The device according to claim 1, wherein the explosive device is part of a munition.

3. The device according to claim 1, wherein the casing includes webs on opposite ends of the one or more voids, with the webs being broken by shock stress and pressure forces due to detonation of the explosive material.

4. The device according to claim 1, wherein a major direction of at least some of the one or more voids is perpendicular to major surfaces of the casing.

5. The device according to claim 1, wherein the fragments are rectangular, cubic, regular polyhedral, irregular polyhedral, parallelepiped fragments, and/or spherical.

6. The device according to claim 1, wherein the fragments are all of the same size.

7. The device according to claim 1, wherein the fragments include fragments of different sizes.

8. The device according to claim 7, wherein some of the fragments are at least twice the volume of other of the fragments.

9. The device according to claim 1, wherein the explosive device is part of a warhead.

10. The device according to claim 1, wherein the casing is made of metal.

11. The device according to claim 1, wherein the casing is made of plastic.

12. The device according to claim 1, wherein the casing is made by an additive manufacturing process.

13. The device according to claim 1, wherein a major direction of at least some of the one or more voids is not perpendicular to major surfaces of the casing.

14. The device according to claim 1, wherein the one or more voids have an elongate cross-sectional shape.

* * * * *